United States Patent [19]

Ming

[11] 3,944,022

[45] Mar. 16, 1976

[54] TREE CLIMBING STAND

[76] Inventor: Joseph W. Ming, Hardscrabble Road, Cassville, N.Y. 13318

[22] Filed: May 9, 1975

[21] Appl. No.: 576,088

[52] U.S. Cl. ..... 182/20; 182/135; 182/187; 224/9

[51] Int. Cl.[2] ..... A47C 9/10

[58] Field of Search ..... 182/20, 187, 53, 54, 55, 182/57–61, 134, 135, 136, 133; 248/236, 216, 221, 230, 246, 223; 224/9

[56] References Cited

UNITED STATES PATENTS

| | | | |
|---|---|---|---|
| 3,352,379 | 11/1967 | Riggs | 182/20 |
| 3,353,629 | 11/1967 | Brunes | 182/20 |
| 3,368,725 | 2/1968 | Martin | 182/187 |
| 3,460,649 | 12/1969 | Baker | 182/187 |
| 3,485,320 | 12/1969 | Jones | 182/187 |
| 3,730,294 | 5/1973 | Thurmond | 182/20 |

*Primary Examiner*—Reinaldo P. Machado
*Attorney, Agent, or Firm*—Bruns & Jenney

[57] ABSTRACT

A tree-climbing platform has a stand portion of rigid sheet material and a pair of tubular runners secured to either side of the stand spaced thereabove. The tree-contacting end of the stand has a V-notch at the center and projecting teeth formed in plates secured to the stand along the sides of the notch. The runners project beyond this end and a crossbar having a toothed plate secured to the center thereof is adjustably and removably secured at each end to the runners. Stirrups for the feet of the climber are secured to the stand adjacent the V-notch and a seat of fabric belting looped around the runners is provided above the stirrups. Back-pack straps are removably secured to the under side of the stand and pads are provided for being secured looped around the toothed plates at the V-notch when the platform is backpacked. A hand climber accessory for the platform comprises a tubular handle and a rope adapted to be secured to one end of the handle, then passed around a tree and wound in several turns around the other end of the handle.

8 Claims, 11 Drawing Figures

TREE CLIMBING STAND

BACKGROUND OF THE INVENTION

This invention relates to a tree climbing platform and a hand-climber accessory for use therewith for climbing trees or poles.

There are many such platforms now available which are principally used by archer hunters for elevated platforms which raise them above the usual field of sight of game, usually deer, so that the game may approach within range. Some of the known platforms and hand-climber accessories have flexible metal straps with teeth projecting therefrom for contact with the tree trunk, or have chains or other flexible members, or have V-notches with projecting, horizontally extending blades. Such climbing platforms may be adapted for climbing poles or tree trunks with bark but are unsteady or slip when climbing a trunk with bark. Other platforms are not adapted for climbing at all.

SUMMARY OF THE INVENTION

The present invention contemplates a lightweight platform having a stand portion of rigid sheet material on which a hunter can stand, one end of the stand having projecting teeth for engaging one side of a tree trunk. Tubular runners at each side of the stand have the major portion of their length secured spaced above, and parallel to, the stand. The runners project beyond the toothed end of the platform and are adapted to pass on either side of a tree trunk. The projecting ends of the runners have a crossbar adjustably and removably secured at either end to the runners, the crossbar having teeth projecting therefrom for engaging the tree trunk on the opposite side from that engaged by the platform teeth. The runners being spaced above the stand, the crossbar teeth are likewise spaced and, when the crossbar is secured to the runners the stand is secured horizontal by the cantilever action of the teeth engaged with the tree trunk.

When disengaged from the tree, the platform may be inverted and used as a sled, the runners supporting the stand thereabove on which a carcass can be carried. The ends of the runners are curved and bent toward the platform and secured thereto at the end of the platform remote from the toothed end thereof providing means for the runners to pass over obstructions.

Stirrups are provided on the surface of the stand adjacent the toothed end thereof, when the platform is in tree-climbing position, for engagement with the feet of the climber. A seat is provided, supported by belts passing buckled around the runners from side to side when the platform is in tree climbing position and after the climber has reached the desired height.

The surface of the stand which is the undersurface when the platform is in tree-climbing position is provided with removable and adjustable back-pack straps and the platform can be back-packed with the projecting ends of the runners up.

The stand may be used with any of the known hand-climber accessories but a preferred hand climber is provided comprising a handle formed of a straight piece of tube substantially as long as the largest tree to be climbed and a length of rope. The rope is adapted to be tied at one end around one end of the tubular handle, passed around the trunk twice, and then wound around the other end of the handle for several turns. One hand of the climber engages the handle near the knot, the other hand engaging the other end of the handle over the turns of rope as the climber pulls himself and the platform upward with his arms.

The rope of the hand-climber accessory is also useful when the platform is used as a sled or is back-packed. The ends of the rope may be tied to the forward end of the sled for pulling by one or more hunters. When used as a back-pack the platform may have rope tied around the runners from side to side for securing other supplies within the back-pack. The handle may be conveniently stored within the projecting end of one of the tubular runners.

DESCRIPTION OF THE PREFERRED EMBODIMENT

Figure 1:
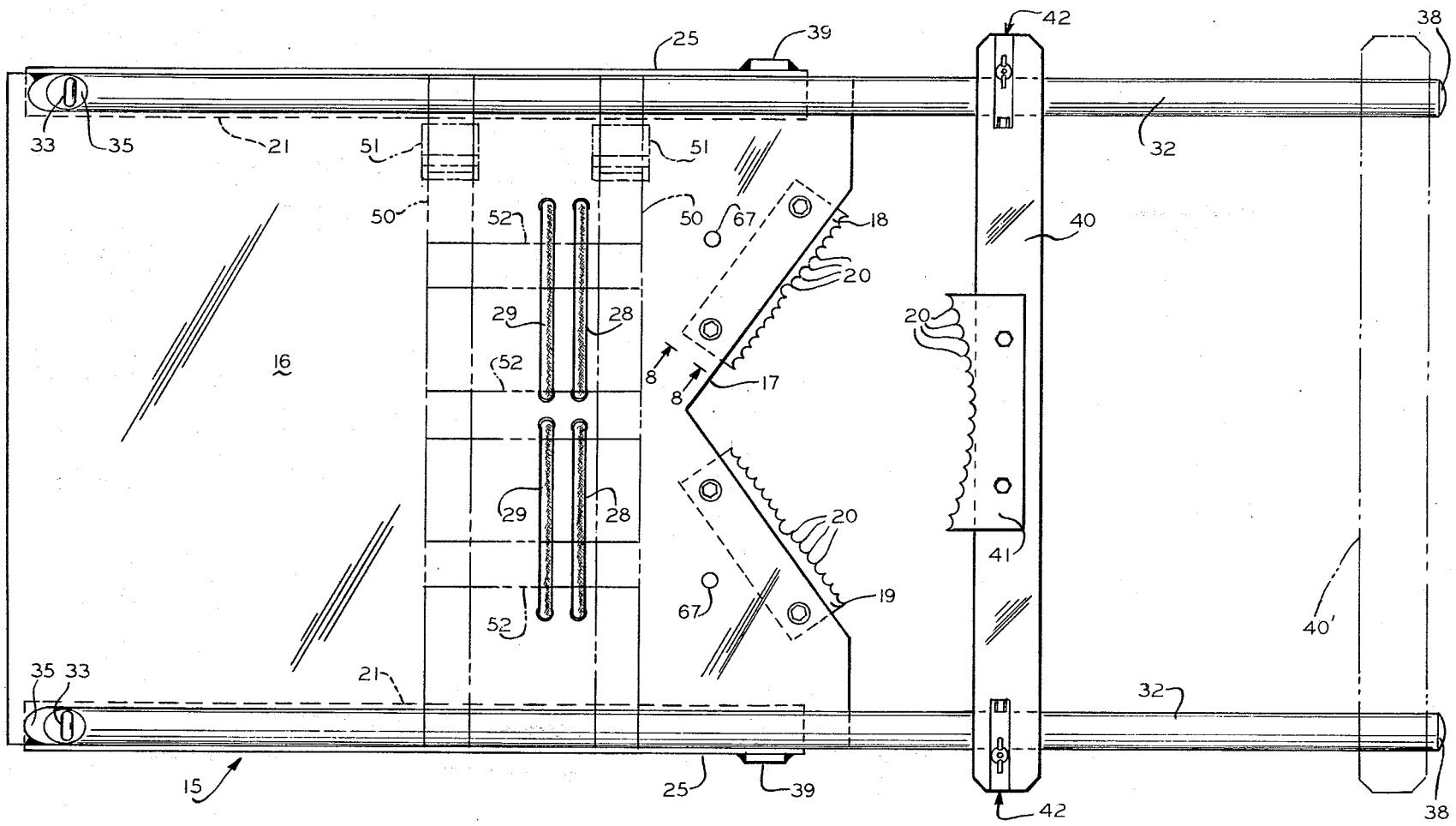
FIG. 1 is a plan view of a platform according to the invention in tree climbing position, a seat for the user and the extended position of the crossbar being indicated in broken lines.

Referring particularly to FIGS. 1–4, the tree-climbing platform 15 comprises a generally rectangular stand or platform 16 of plywood or fiberglass or similar sheet material having a V-shaped notch 17 at the end of the stand adapted to contact a tree to be climbed. Two plates 18 and 19 are bolted respectively parallel to the two edges of the notch. An edge of each plate projects beyond stand 16 and this edge has a plurality of adjacent and intersecting arcuate notches cut therein forming projecting teeth 20 therebetween, as shown.

Figures 2, 4, 5, 6, 10:
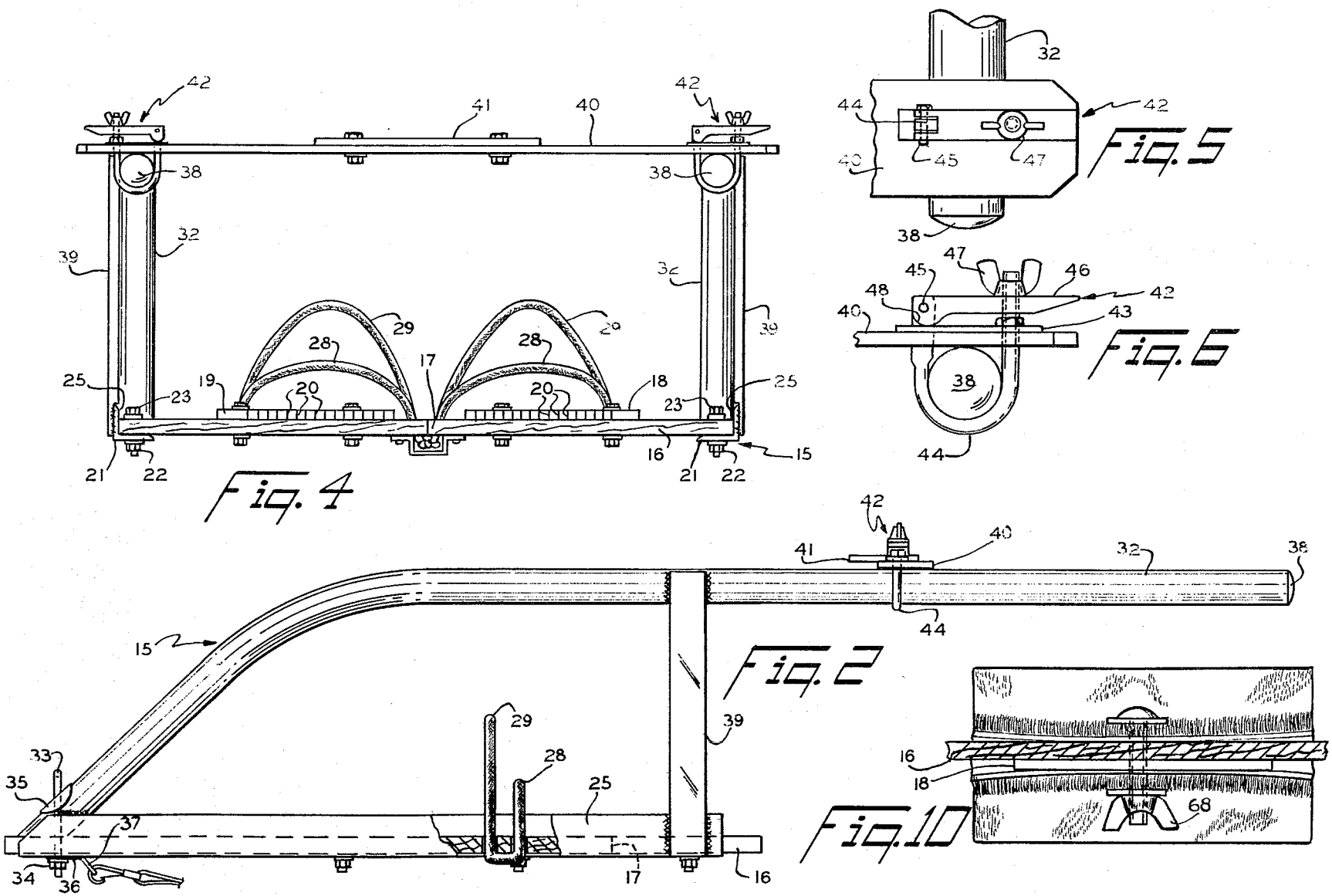
FIG. 2 is a side elevational view thereof.
FIG. 4 is an end view thereof as viewed from the right in FIG. 1.
FIGS. 5 and 6 are fragmentary enlarged plan and side elevational views, respectively, of the adjustable fastening means at each end of the crossbar.
FIG. 10 is a sectional view on the line 10—10 of FIG. 3 and showing a tooth-covering pad for use when the platform is used as a back-pack.
Figure 3:
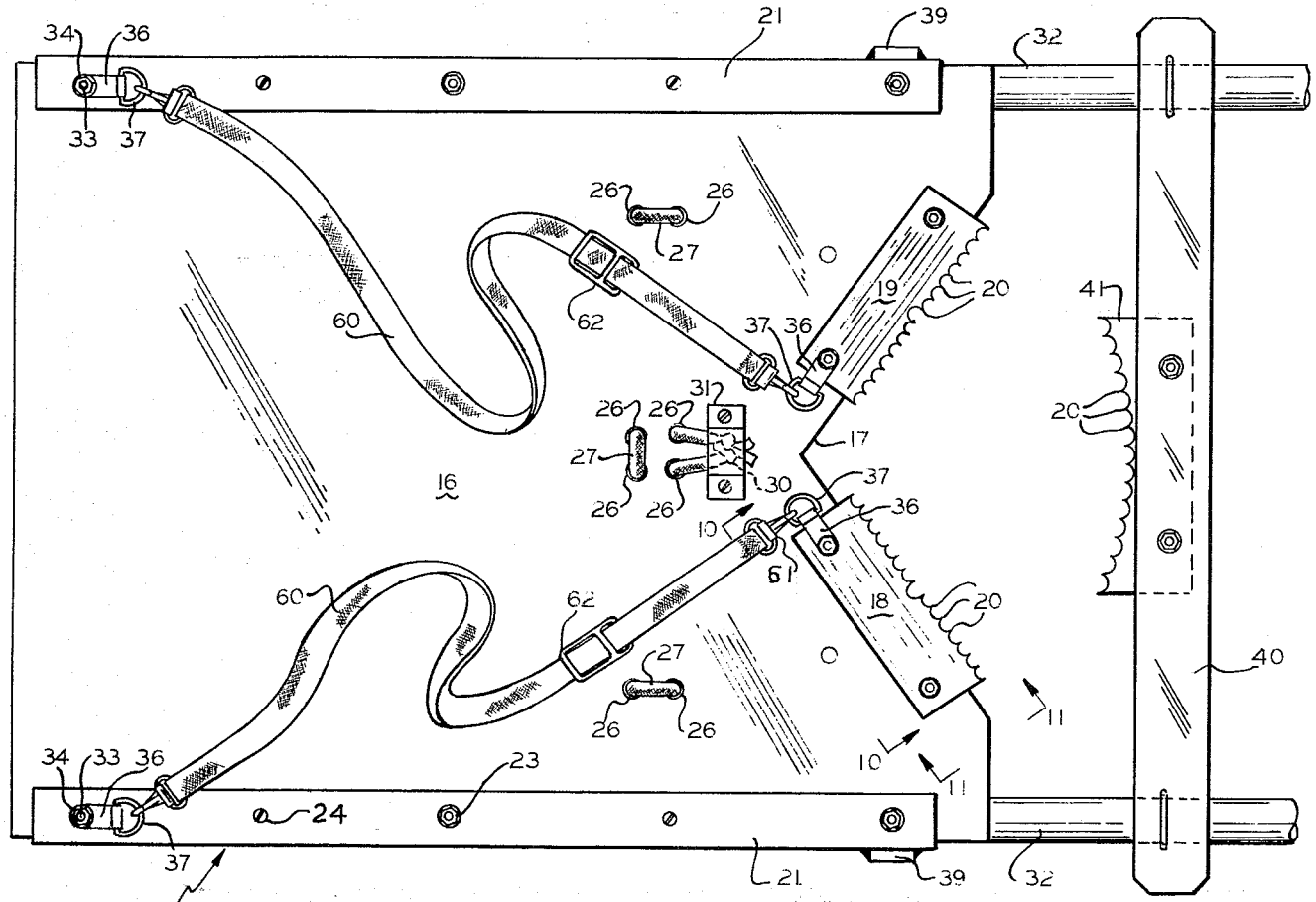
FIG. 3 is a fragmentary bottom plan view thereof.

Stand 16 is supported on each side on a metal angle, 21, preferably of aluminum, secured by bolts 22 and nuts 23, best seen in FIG. 4, and screws 24, best seen in FIG. 3, to the stand. Each angle 21 has an upwardly projecting flange 25 alongside the stand.

Just forward of the notch 17 the stand 16 has eight holes 26 therethrough, arranged as shown in FIG. 3, and through the holes 26 a cord 27 is laced, as shown, to form the stirrups 28 and 29 seen in FIG. 1. As seen in FIG. 4, the stirrups 28 are shorter and adapted to be engaged by the toes of the climber and the longer stirrups 29 are adapted to be looped behind the heels of the climber. As seen in FIG. 3, the ends of cord 27 may be knotted at 30 and the knot secured compressed in a knot holder 31 secured to the underside of stand 16.

Figure 8:
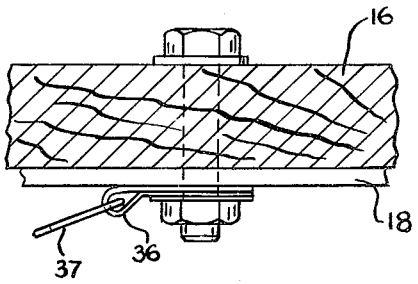
FIG. 8 is a fragmentary enlarged sectional view on the line 8—8 of FIG. 1.
Figure 7:
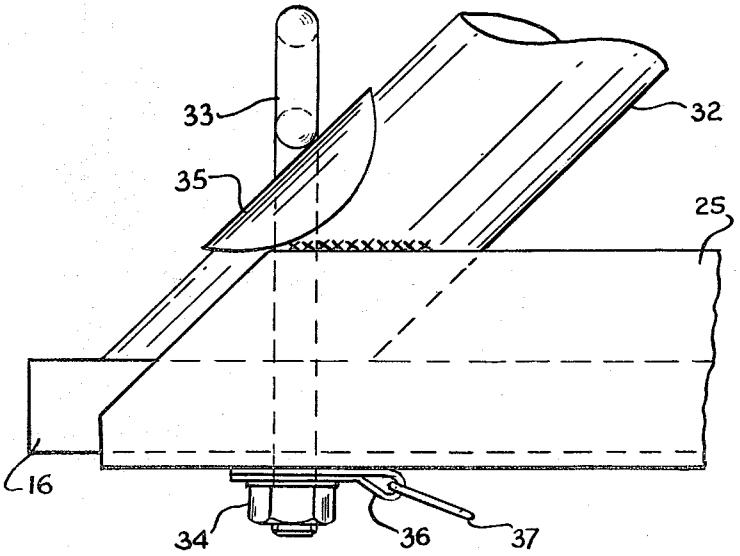
FIG. 7 is a fragmentary enlarged side elevational view of the means for fastening the end of a tubular member to the platform.

At either side, the stand 16 has secured thereto the forward end, the end away from the tree, of a tube 32, preferably of aluminum, by means of an eyebolt 33 and nuts 34, best seen in FIG. 7. A washer 35, bent to conform to the shape of tube 32, is interposed between the eye of bolt 33 and tube 32 and a bracket 36 secured to a D-ring 37 is interposed between nut 34 and angle 21. A similar bracket 36 and D-ring 37 is secured by one of the bolts securing plates 18 and 19 to the stand, as shown in FIG. 3, for a purpose which will appear, and as best seen in FIG. 8.

Each tube 32 extends upward and toward the end of platform 16 adapted to contact a tree and then curves, as best seen in FIG. 2 to the major portion of the length of the tube which lies above and parallel to angle 21 and extends beyond the rearward end of platform 16. A plug-type cap 38 may be used at the rear end of each tube 32. At the rear end of each angle 21 a vertical aluminum column or bar 39 spaces each tube 32 thereabove, one end of each column being welded or otherwise secured to flange 25, and the other end of the column being welded or secured to the tube 32, as shown.

Mounted on the rearward ends of tube 32 is a crossbar 40 bearing at its center another plate 41 bolted to the top surface of crossbar 40. The adjustable plate 41 has teeth 20 formed substantially like the teeth 20 of plates 18 and 19, the teeth being arcuately disposed, however, instead of in a straight line. The arcuate notches cut in the edge of each plate have a radius of about one-fourth inch and the distance between the centers of adjacent notches is about one-half inch which results in sharp pointed teeth 20 capable of biting into a tree or pole for a distance of at least one-fourth inch.

Each end of crossbar 41 is adjustably secured to a respective tube 32 by a shackle device 42, best seen in FIGS. 5 and 6. The device 42 has a plate member 43 adapted to lie flat on the surface of bar 40 and a U-shaped shackle bolt 44 adapted to encircle the tube 32 with each leg extending through appropriate holes in bar 40 and plate 43. One leg is pivotally secured at 45 to one end of a locking lever 46, the other leg being threaded to receive a wing nut 47. The end of lever 46 carrying pivot pin 45 has a projecting cam surface 48 adapted to tighten shackle bolt 44 about tube 32 when lever 46 is tightened by nut 47. A spacer nut 49 may be provided on the threaded leg of bolt 44 to hold plate 43 loosely engaged with bar 40 when the wing nut 47 is loosened.

Crossbar 40 is adjustable from a position shown in full lines in FIG. 1 to a position indicated in broken lines at 40' in the same Figure. The position shown in full lines adapts the toothed plates to engage the perimeter of a tree about 7 inches in diameter and the position shown in broken lines adapts the toothed plates to engage the perimeter of a tree about 18 inches in diameter, the arc of the teeth on the adjustable plate 41 substantially conforms to the perimeter of this maximum sized tree.

Shown in broken lines in FIg. 1, two canvas belts 50 are indicated wrapped about tubes 32 at either end and secured by buckles 51. A plurality of cross straps 52 may be stitched at either end to the belts 50 to form a seat for the hunter, or the belts 50 themselves may serve as a seat. It will be understood that reference to forward and rearward directions relate to the usual position of a waiting hunter seated on the above described seat with his back to a tree or a hunter ready to shot when standing to the left of the seat in FIG. 1 and facing away from the tree.

Figure 9:
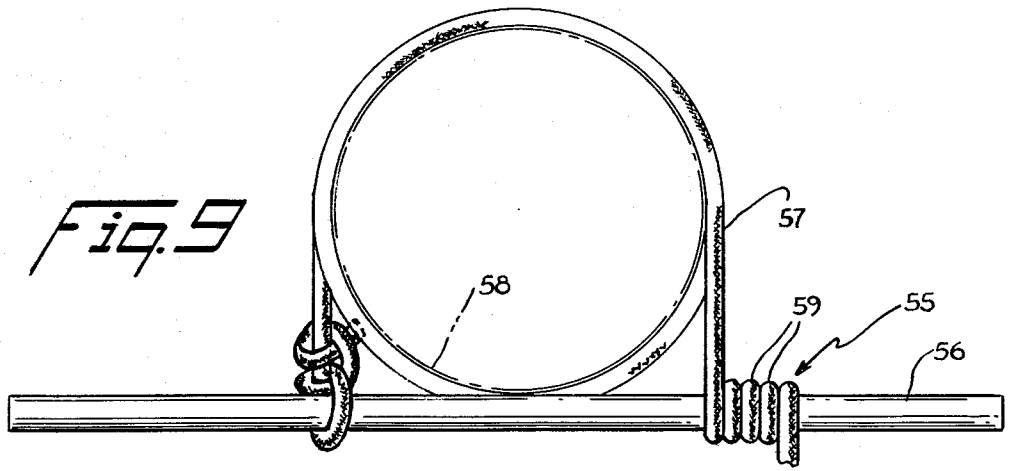
FIG. 9 is a plan view of a hand-climber accessory for the tree climber-platform of FIG. 1, a tree trunk being diagrammatically shown in broken lines.

Referring now to FIG. 9, a hand-climber accessory 55 comprises a hand bar or handle 56 and a length of rope 57 which may be as long as desired. Preferably the rope is ⅜ inch diameter hemp or other rope and the handle is of aluminum tubing having a length substantially exceeding or equalling the diameter of the trees to be climbed and of an outside diameter less than the inside diameter of the tubes 32 so that it may be stored in one of the tubes 32 by removing its cap 38. As shown in FIG. 9, one end of rope 57 may be secured by a figure-8 or similar knot to the bar 56, the rope then passed twice around a tree indicated at 58, the handle 56 being drawn against the tree and the free end of rope 57 then wound around the handle as shown at 59 and tied around the waist as a safety precaution.

For climbing, the platform 15 and accessory 55 may be used by sliding the crossbar 40 off of the free ends of the tubes 32, placing the platform 15 with the tubes 32 on either side of the tree and with the teeth of plates 18 and 19 engaging the tree. The bar 40 is then replaced with the teeth of plate 41 engaging the tree and the bar is locked in place. The climber then places his feet in the stirrups 28 and 29 facing the tree.

The hand accessory 55 is then arranged as shown in FIG. 9, the climber passing the loop rope 57 as high as he can reach. One hand grasps the bar near the knot and the other hand is placed over the turns of rope at 59. The rope may be tightened by rotating the loops in one direction and loosened by turning the loops in the other direction.

The climber then pulls himself up as far as he can by his arms while bending his knees, his feet raising the stand 16 and thereby disengaging the teeth 20 of plates 18 and 19 from the tree. When the stand 16 is raised as high as possible by bending the knees, the climber then places his weight again on the stand and the platform is then engaged cantilever fashion with the tree. The hand accessory is again raised and the cycle is repeated.

Referring now to FIG. 2, it will be seen that by turning the platform 15 upside down it may serve as a sled for hauling the game after it is shot. By sliding bar 40 off of the free ends of tubes 32, reversing it upside down and sliding it back near to the position indicated at 40' in FIG. 1, the bar 40 becomes an adjunct to the stand portion 16 for supporting the carcass. The tubes 32 serve as runners, unobstructed except for the curved portions of the shackle bolts 44 adjacent the now trailing ends of the tubes. The sled may be pulled by attaching the rope 57 of the hand apparatus 55 to the eyes of the bolts 33 at the now forward end of the sled. This use of rope 57 usually determines its desired length.

Referring now to FIG. 3, fabric straps 60 are provided with hook fasteners 61 at either end which may be engaged with the D-rings 37 at either end of a stand 16 on either side. Sliding buckles 62, as are usually provided in pack-straps, serve to regulate the length of the straps. The bar 40 may be positioned at any appropriate point along the tubes 32 and the rope 57 of hand apparatus 55 may be looped around the tubes 32 like seat straps 51 to provide a cargo-carrying area between tubes 32 and stand 16 as can best be seen in FIG. 4.

Figure 11:
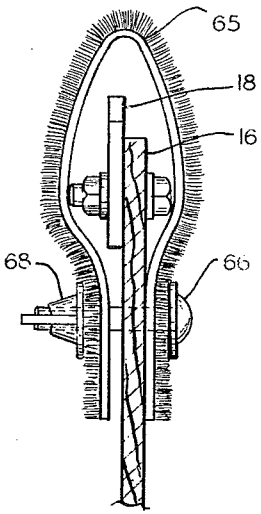
FIG. 11 is a sectional view on the line 11—11 of FIG. 3, showing the same pad.

Referring to FIGS. 10 and 11, pads 65 may be provided for wrapping around the plates 18 and 19 when the platform 15 is back-packed. The pads 65 cover the teeth 20 on the plates and each may be secured in position by a bolt 66 passing through both ends of the pad and through a hole 67 (FIG. 1) in stand 16. A wing nut 68 may be provided for use with the bolt 66. Alternatively snap fasteners may be provided on the ends of pads 65 and on both surfaces of stand 16. Pads 65 are preferably made of thick pile carpet-type material, as shown, and provide means for spacing stand 16 away from the back of the packer sufficiently so that the knot holder 31 does not come in contact with the back of the packer.

While the platform 15 has been described above as a hunter's platform it will be apparent that it may have other uses such as a pole climbing device or an equipment-storage platform for use with utility poles.

I claim:

1. A tree-climbing platform comprising a substantially rectangular stand portion of rigid sheet material having a V-notch at one end, a tubular runner at either side of the platform, the main portions of each runner being secured to the stand parallel to and spaced thereabove, the stand having a metal plate secured thereto along each side of the V-notch, each plate having teeth along one edge projecting beyond the stand for engagement with a tree trunk, the stand having stirrups secured thereto adjacent the V-notch adapted for engagement with the feet of a climber, each runner projecting beyond the V-notched end of the stand and adapted to extend on either side of a tree trunk to be climbed, a crossbar removably secured at each end to a runner, the crossbar having a metal plate secured thereto at its center, the crossbar plate having teeth along one edge projecting from the crossbar and adapted to contact the tree trunk on the side opposite that contacted by the V-notch plates teeth, whereby a climber may embrace a tree with his arms while bending his knees to raise the platform and then put his weight on the platform to reengage the platform with the tree and thereafter grasp the tree at a higher level for again raising the platform.

2. The platform defined in claim 1 wherein the runners project beyond the V-notched end of the stand a distance sufficient to allow the crossbar to be secured to the runners at a distance whereby the distance between the V-notch plates teeth and the crossbar plate teeth spans a tree trunk 18 inches in diameter.

3. The platform defined in claim 1 wherein the V-notch plates teeth and the crossbar plate teeth are formed by arcuate, vertically extending notches cut at evenly spaced intervals to intersect and form at their intersection sharp pointed teeth at least one-fourth inch long.

4. The platform defined in claim 1 wherein the tubular runners are curved at one end toward the stand and secured thereto at the end opposite the V-notched end of the stand, whereby the platform may be inverted with the runners down to form a sled for carrying game shot from the platform.

5. The platform defined in claim 1 wherein the surface of the stand opposite the surface to which the stirrups are attached has a pair of back-pack straps removably secured thereto, whereby the platform may be back-packed, the projecting ends of the runners projecting upward.

6. In combination with the platform defined in claim 1, a hand-climber accessory comprising: a tubular handle at least equal in length to the diameter of the tree to be climbed, and a rope, one end of the rope being knotted around the handle adjacent one end, the rope being adapted to be passed around a tree to be climbed, and the rope being wound around the other end of the handle in a plurality of turns, whereby a climber grasps the handle adjacent the knot with one hand, wraps the rope around the tree and around the other end of the handle and grasps the handle with the other hand around the turns and pulls himself upward with his arms when climbing with the platform.

7. The platform defined in claim 3 wherein the teeth of the crossbar carried plate are arranged arcuately, the radius of the arc being at least substantially half the diameter of the tree to be climbed.

8. The platform defined in claim 5 wherein the V-notch plates have thick pads of textile material wrapped therearound covering the teeth, the ends of the pads being secured to the stand.

* * * * *